US007124892B2

(12) United States Patent
Garcia

(10) Patent No.: US 7,124,892 B2
(45) Date of Patent: Oct. 24, 2006

(54) SAFETY CONE HOLDER DEVICE

(75) Inventor: Guadalupe C. Garcia, Modesto, CA (US)

(73) Assignee: Worldwide Safety LLC, Sacramento, CA (US)

( * ) Notice: Subject to any disclaimer, the term of this patent is extended or adjusted under 35 U.S.C. 154(b) by 0 days.

(21) Appl. No.: 10/900,025

(22) Filed: Jul. 26, 2004

(65) Prior Publication Data

US 2005/0051452 A1 Mar. 10, 2005

Related U.S. Application Data

(60) Provisional application No. 60/491,936, filed on Jul. 31, 2003.

(51) Int. Cl.
*B65D 85/00* (2006.01)

(52) U.S. Cl. ..... 206/577; 206/526; 206/575

(58) Field of Classification Search ..... 206/525, 206/526, 575, 577, 803; 220/4.23
See application file for complete search history.

(56) References Cited

U.S. PATENT DOCUMENTS

| | | | | |
|---|---|---|---|---|
| 1,861,948 | A * | 6/1932 | Barkdoll | 206/315.9 |
| 2,333,273 | A | 11/1943 | Scanlon | 116/63 R |
| 3,132,624 | A | 5/1964 | Shoemaker, Jr. | 116/63 R |
| 3,386,409 | A | 6/1968 | Dawson | 116/63 R |
| 3,504,787 | A * | 4/1970 | Brockway | 206/570 |
| 4,541,528 | A * | 9/1985 | Holmes | 206/0.82 |
| 4,753,366 | A * | 6/1988 | Ritter | 206/493 |
| 4,925,334 | A | 5/1990 | Beard | 404/9 |
| 5,366,088 | A * | 11/1994 | Hill et al. | 206/499 |
| 5,375,554 | A | 12/1994 | Yen | 116/63 C |
| 5,488,792 | A | 2/1996 | Kwok | 40/612 |
| 5,938,023 | A * | 8/1999 | Herron et al. | 206/315.11 |
| 6,527,245 | B1 | 3/2003 | Graves et al. | 248/518 |
| 6,726,434 | B1 | 4/2004 | Orthaus et al. | 414/539 |
| 6,752,582 | B1 | 6/2004 | Garcia | 414/467 |
| 6,758,331 | B1 * | 7/2004 | DeHart | 206/229 |
| 2002/0179804 | A1 | 12/2002 | Graves | 248/518 |
| 2004/0057822 | A1 | 3/2004 | Orthaus et al. | 414/539 |

* cited by examiner

*Primary Examiner*—David T. Fidei
(74) *Attorney, Agent, or Firm*—Lumen Intellectual Property Services

(57) ABSTRACT

The present invention provides a holder device for securing one or more non-rigid safety cones, each of which having a flexible conical part that can be reduced to a small volume substantially linearly. The holder device has an open frame construction and is lightweight, compact, and durable. The holder device has two bracket-like main components that are movably joined or connected at one common end and that can be secured or locked together at the other ends. By selecting material and strengthening design configuration of the two components to counteract the spring force of the coil or coils held therebetween, by strategically placing a positioning element to secure the cone or cones centrally, and by supporting their base from at least three sides, the holder device of the present invention offers sufficient support and efficient stowage of non-rigid safety cones in a convenient, secure, and cost effective manner.

18 Claims, 6 Drawing Sheets

SAFETY CONE HOLDER DEVICE

CROSS-REFERENCE TO RELATED APPLICATIONS

This application claims the benefit of the Provisional Patent Application No. 60/491,936, filed Jul. 31, 2003, the entire content of which is incorporated herein by reference. This application also relates to U.S. Pat. No. 6,766,760.

BACKGROUND OF THE INVENTION

1. Field of the Invention

The present invention generally relates to holding devices. More specifically, the present invention relates to a holder device particular suitable for holding, storing, carrying, and/or packaging non-rigid, flexible safety cones in a convenient and compact manner.

2. Description of the Related Art

Traffic marker devices such as safety cones are useful in alerting, informing, directing, or diverting motorists as well as pedestrians to avoid or pass safely around hazards, obstacles, work zones, and so on. Currently available safety cones can be generally divided into two main categories: rigid ones and non-rigid ones.

Rigid safety cones are well known in the art, an example of which is disclosed in the U.S. Pat. No. 2,333,273. The U.S. Pat. No. 6,726,434 shows how rigid safety cones are deployed from a specially designed deployment vehicle. Conventional rigid safety cones are not particularly suitable for consumer applications because they are awkward to handle and/or carry around. Their weight, size and bulkiness in general make it difficult to transport and store, for example, in a trunk or cargo area of a vehicle. This problem worsens with an increase in the number of rigid safety cones that need to be held, carried around, or stored together in the trunk or any place where space is limited or minimal.

Non-rigid safety cones can be further divided into subcategories: collapsible ones that can be compressed in a substantially flat form, as exemplified in the U.S. Pat. No. 3,132,624, and a new generation of self-righting flexible ones disclosed in the U.S. Pat. No. 6,766,760, of which is issued to the same inventor and assigned to the same assignee of the present application.

Unlike rigid safety cones, non-rigid safety cones such as the collapsible signal device disclosed in the aforementioned U.S. Pat. No. 3,132,624 can be compressed into a compact, substantially flat form, making them more suitable for individual use and storage. For example, a built-in hinged bar secures the collapsed, substantially flat signal device of the U.S. Pat. No. 3,132,624 under a hook fixed onto the base thereof. The collapsed device is then stowed in a separate storage case with a cover flap.

Other ways to stow, hold, carry, pack, and store collapsible safety cones exist, each of which is usually tailored to a specific design. For example, for carrying and storing the collapsible rocking road emergency warning sign of the U.S. Pat. No. 5,375,554, a separate top cover is latched onto the base of the warning sign via two clips. In another example, for carrying and storing the collapsible traffic warning sign of the U.S. Pat. No. 5,488,792, a circular recess on the base thereof is designed to receive the conical covering and spring of the warning sign in collapsed form and a separate case is designed to receive the collapsed warning sign.

A common trait in conventional collapsible safety cones is that they are structurally weakened by design to allow the overall height of the cone to be compressed or flattened.

Another common trait is that they generally cannot self-right. Consequently, when confronted by an indirect or direct force, e.g., natural wind, passing traffic, or violence, collapsible safety cones are likely to fall over or collapse, thereby becoming a flying or lying object endangering following traffic and/or surrounding people. Moreover, conventional collapsible safety cones are not suitable for vehicular deployment. They are more suitable for individual use.

The above-referenced U.S. Pat. No. 6,766,760 discloses a new generation of flexible safety cones that can be deployed and placed via a moving vehicle and can self-right upon deployment or perturbation. The U.S. Pat. No. 6,752,582, which is also issued to the same inventor and assigned to the same assignee of the present application, discloses a novel method and device for placing and deploying the self-righting flexible safety cones from a moving vehicle, which is minimally modified to implement the placing device.

For stowage and carriage, the self-righting flexible safety cones can be conveniently reduced to a compact size without compromising the structural integrity and resilience thereof. What is needed in the art, therefore, is a holder device that can secure one or more self-righting flexible safety cones in a reduced or otherwise minimized form so that they can be held, carried, packaged, stowed, and/or stored in a compact, convenient, and effortless manner. The present invention addresses this need.

SUMMARY OF THE INVENTION

The present invention provides a holder device for securing one or more non-rigid safety cones, including collapsible ones and self-righting flexible ones discussed above, so long as such safety cones have a flexible conical part that can be spring-loaded or compressed to a small volume. In an exemplary embodiment, the flexible conical part is a coil spiraling into a cone shape.

The holder device according to the present invention has an open frame construction, is lightweight, compact, and durable, and can conveniently fasten or hold one or more non-rigid safety cones in an effective and secure manner. The holder device has two bracket-like main components that are movably joined or connected at one common end. Preferably, the material and design configuration of the two main components are selected to provide the strength necessary to withstand the maximum spring force exerted from the coil or coils held therebetween, thereby allowing the flexible safety cone or cones to be stored therein in a compressed, spring-loaded position.

An advantage of the holder device of the present invention is its capability of holding both types of non-rigid safety cones devices. Ordinary holding devices such as those described before, while adequately designed to hold collapsible safety cones in collapsed form, are not capable of holding the self-righting flexible safety cones due to their significant counteracting force of extension from the coil.

Other objects and advantages of the present invention will become apparent to one of ordinary skill in the art upon reading and understanding the detailed description of the preferred embodiments below with reference to the following drawings.

DETAILED DESCRIPTION OF THE PREFERRED EMBODIMENTS

Figure 1:
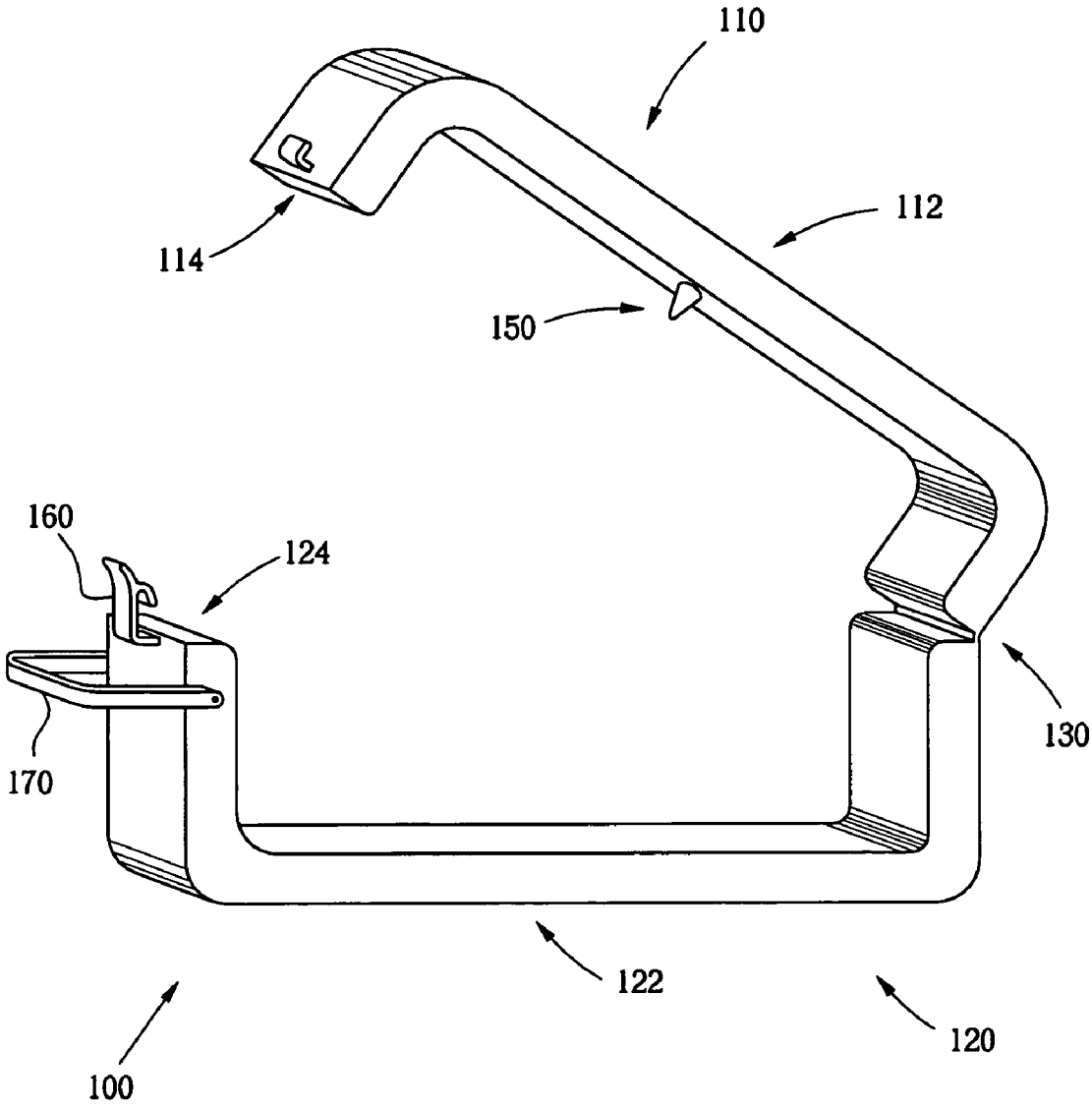
FIG. 1 shows an exemplary embodiment of a holder device according to the present invention.

FIG. 1 shows an exemplary holder device 100 for holding and carrying one or more non-rigid safety cones each having a flexible cone or conical part. Preferably, each non-rigid cone can be reduced to a small volume substantially linearly from the top of it conical part downwardly towards its base. According to an aspect of the present invention, the holder device 100 is particularly suitable for holding and storing the self-righting flexible safety cones, although it can also be used for holding and storing collapsible safety cones of all sorts.

The holder device 100 has two main components 110, 120 that are movably joined or connected at a common end 130. Dependent upon the manufacturing procedure of choice, the components 110, 120 and the movable joint/connection 130 could be separate elements assembled by a connection means (such as a hinge or joint). Alternatively, they can be two halves of a single piece of material made by, for instance, but not limited to, injection molding or blow molding.

In the example shown in FIG. 1, the two components 110, 120 are bracket-like, U-shaped components with round edges. As one skilled in the art will appreciate, these bracket-like components can have various shapes, colors, and sizes, so long as they are lightweight, compact, and strong enough to hold one or more safety cones. In addition, they are not limited to rounded edges. The edges could be straight or a combination of rounded and straight edges.

The components 110, 120 can be made of any suitable material in various forms, so long as they are able to withstand and/or counteract the extension or spring force exerting from the flexible conical part, i.e., coil, when the safety cone is reduced to small volume. The strength of the material is important since one of the key aspects of the holder device 100 is that it can store one or more flexible safety cones in a spring-loaded position. Preferably, the components 110, 120, especially the middle areas 112, 122, are strong enough to avoid or substantially minimize any bending effects caused by the extension force of the spring-loaded cones held/stored therein.

The holder device 100 has an open frame construction. Other than at the common end 130, the two components 110, 120 are open on all sides. To close and secure the holder device, the two components 110, 120 have two ends 114, 124 that are held, fastened, or lock together by, for instance, a holding means 160. The holding means 160 could be a clasp, a latch, a strap, a lock, a clip, a hook, a click-mechanism, or the like. In addition, the holding means 160 could be attached to, fixed on, formed part of, or integrated in either or both ends 114, 124.

In some embodiments, the holder device 100 could also include a handle 170. The handle 170 could be fixed onto, formed part of, or movably jointed either or both components 110, 120. In one embodiment, the handle 170 is manufactured as an integral part of one of the components 110 or 120. Preferably, the handle 170 is manufactured separately and then pivotally connected to one of the components 110 or 120.

The holder device 100 has a positioning element 150 designed to secure one or more flexible safety cones in place. The positioning element 150 is located at the inner side of the component 110. The positioning element 150 preferably has but is not limited to a conical shape. It could have any suitable shape such as cylindrical or square as long as it fits inside the top part or opening of a safety cone. When the holder device 100 is closed, the positioning element 150 holds the safety cone in place via its opening and prevents the conical part of the safety cone from slipping or sliding away. The positioning element 150 could be assembled, attached, or fixed onto the inside of the component 110. Alternatively, it can be an integral part formed with the component 110. Moreover, the positioning element 150 could be hollow or solid. For example, it could be a hollow element that fits around the top opening of a safety cone.

Figure 2:
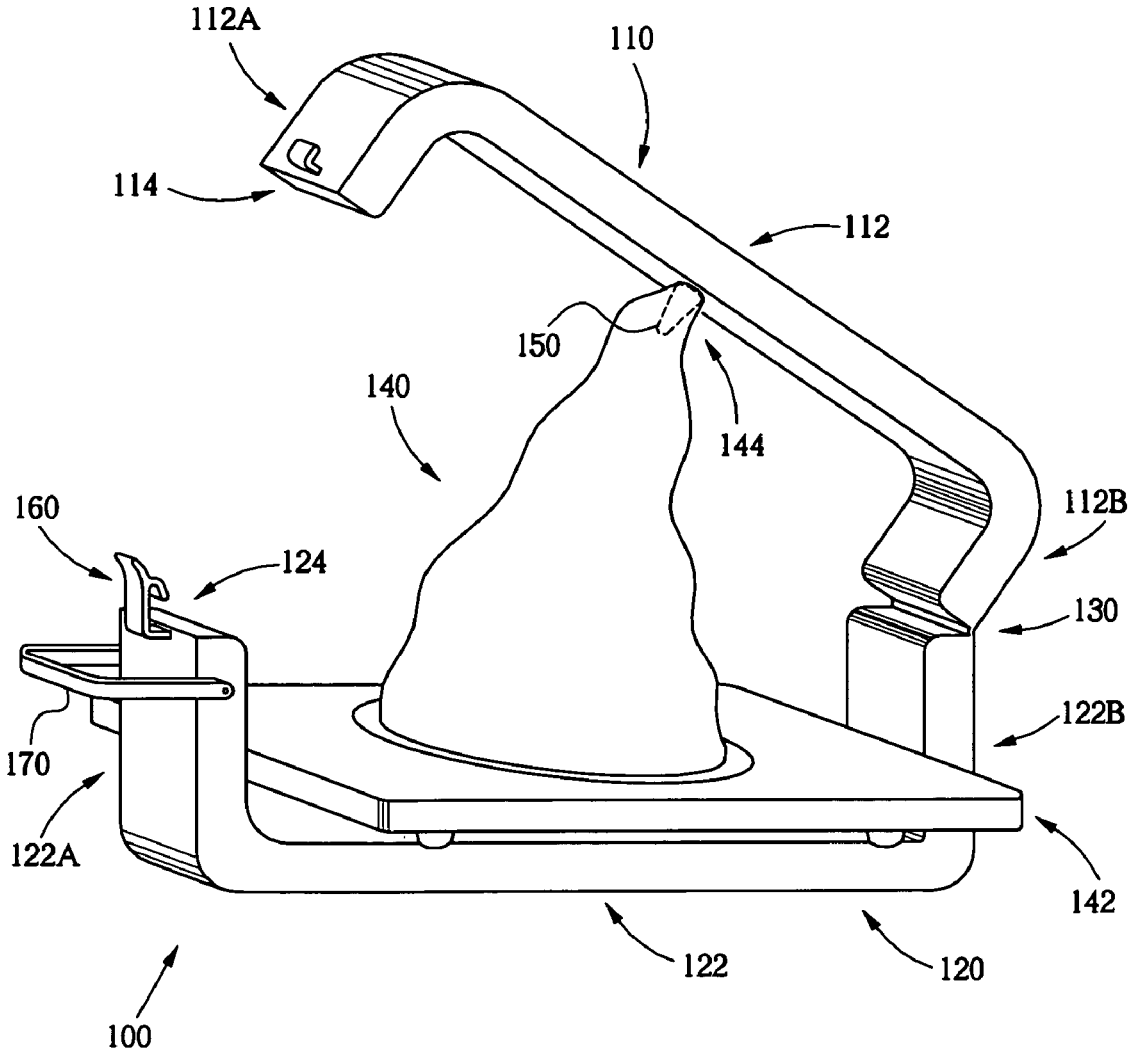
FIG. 2 shows the holder device of FIG. 1 in an open position receiving a flexible safety cone according to the present invention.
Figure 3:
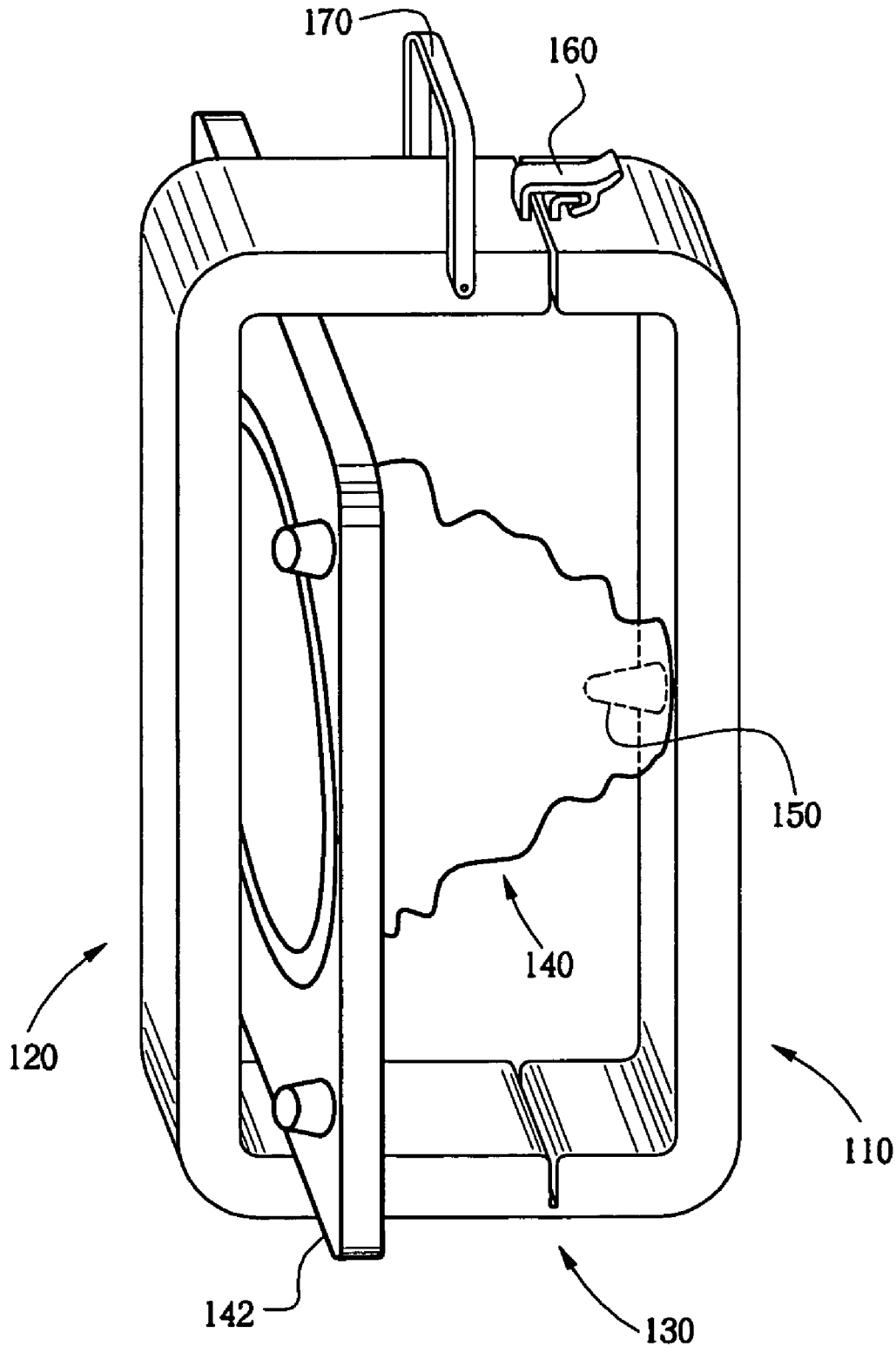
FIG. 3 shows the holder device of FIG. 1 in a closed position holding the flexible safety cone of FIG. 2.

Referring to FIG. 2, a user can place the positioning element 150 inside the top 144 of a safety cone 140 according to the present invention. Once in position, the user can then push down component 110 and therewith the flexible cone part of the safety cone 140 towards the component 120, thus reducing the flexible safety cone 140 into a spring-loaded position. Once the end 114 reaches the end 124, two components 110, 120 can then be securely held together by the holding means 160, as shown in FIG. 3.

According to an aspect of the invention, the component 120 supports the base 142 of the safety cone 140. It is important to note that the component 120 as well as its counterpart 110 does not have to cover the entire base. The inventor of the present invention has discovered that, by strengthening the material and design configuration of the components 110, 120, strategically placing the positioning element 150, and supporting the base on three sides thereof, such an open frame construction of the holder device 100 offers sufficient support and secure stowage in an efficient and cost effective manner.

Figure 4:
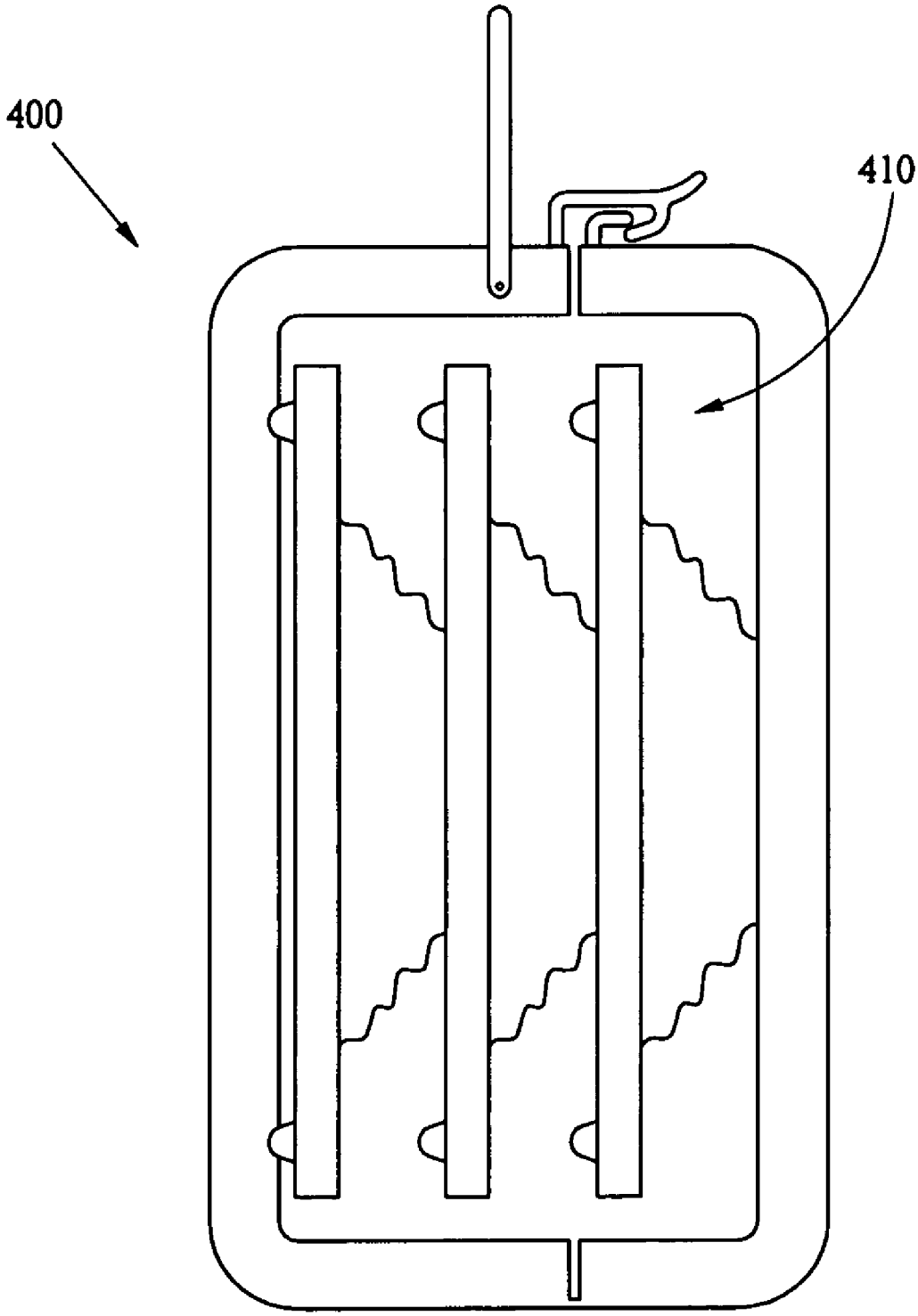
FIG. 4 shows another exemplary embodiment of a multiple capacity holder device according to the present invention.

One skilled in the art can appreciate that the holder device 100 can be scaled to hold any number of safety cones. FIG. 4 shows that multiple safety cones 410 could be stacked together and stored in a holder device 400. Accordingly, heights 112A, 112B and 122A, 122B of components 110 and 120, respectively, are not limiting and can vary depending upon application and/or desire. Similarly, the overall weight, height, and/or size of the holder device 100 can vary depending upon what holding capacity (i.e., the number of safety cones) is desired as well as how small the overall size (i.e., height, width, and depth) of each safety cone is in reduced form.

Moreover, heights 112A, 112B, 122A, 122B could be of equal heights or different heights as long as (1) the two components can rotate or move with respect to each other at one end and (2) the two components can be secured, locked, or otherwise held together at the other end. In preferred embodiments of the invention, holder devices in various sizes hold one, two, three, or four non-rigid safety cones.

Figure 5:
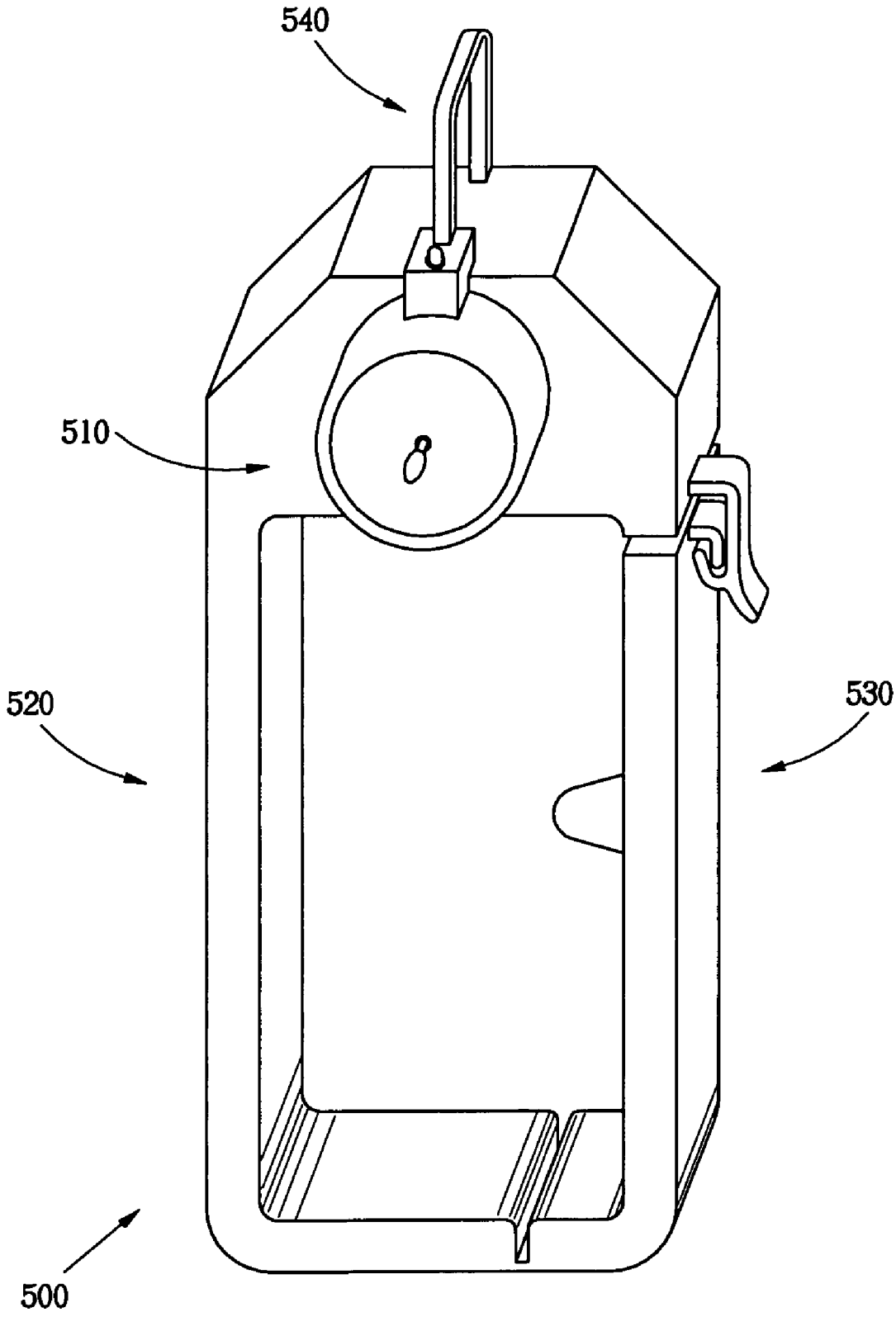
FIG. 5 shows yet another exemplary embodiment of a multiple capacity holder device integrated with a utility component such as a light source, according to the present invention.

In some embodiments, the holder device according to the present invention is integrated with a utility component such as a light source, as shown in FIG. 5. In this example, a holder device 500 having two main components 520 and 530 integrates a light source 510 for enhanced utility. The holder device 500 preferably includes a handle 540. The holder device can also be implemented with bright/reflective materials and/or colors for, e.g., enhanced visibility.

Figure 6:
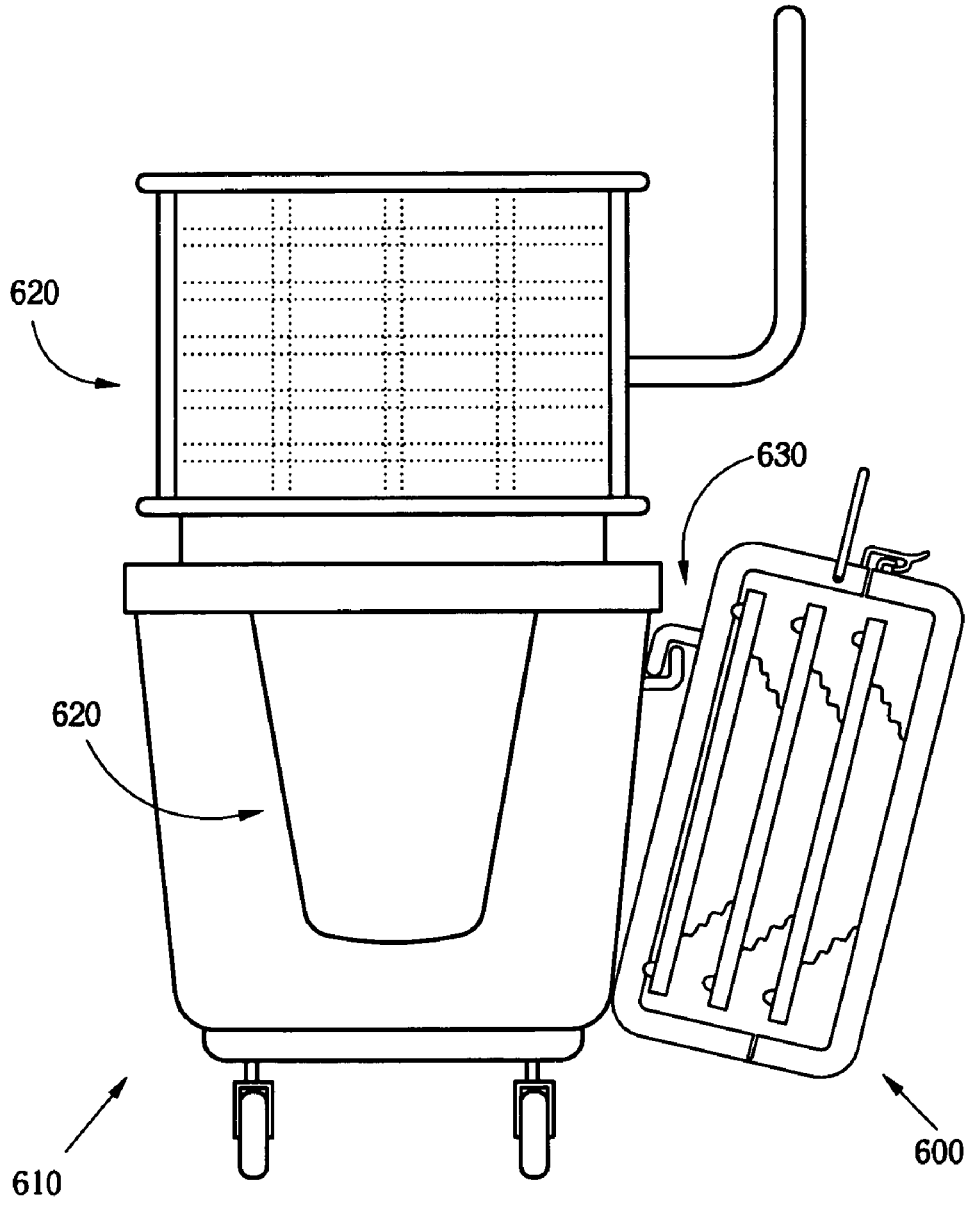
FIG. 6 shows an exemplary embodiment of a multiple capacity holder device integrated with one or more accessories such as a clip, according to the present invention.

In yet another embodiment, shown in FIG. 6, a holder device 600 is detachably attached to a device 610, for instance a service cart with buckets 620. The holder device 600 is preferably implemented with a hook 630, a hole (not shown), an indentation (not shown), or other appropriate accessories and/or features to allow it to conveniently hang from or cling onto the device 610, the buckets 620, or any desired location/place such as a wall or a display rod.

The present invention has now been described in accordance with several exemplary embodiments, which are intended to be illustrative in all aspects, rather than restrictive. Thus, the present invention is capable of many variations in detailed implementations, which may be derived from the description contained herein by a person of ordinary skill in the art without departing from the spirit of the present invention. Accordingly, the scope of the present invention should be determined by the following claims and their legal equivalents.

I claim:

1. A safety cone holding device, comprising:

a first component and a second component movably joined or connected at a common end, wherein each of said first component and said second component are U-shaped and when other ends of said first component and said second component have come together, said first and second component form an opening visible there-through, said opening is sized to hold one or more non-rigid safety cones each of which having a flexible conical part and a base supporting said flexible conical part, and wherein said second component does not extend over said base of the safety cone supported by said second component;

a holding means for latching two open ends of said first and second components; and a positioning element for centrally securing said one or more non-rigid safety cones in a reduced form.

2. The holder device of claim 1, further comprising: a handle for carrying said holder device, wherein said handle is movably attached to or formed part of said first component, said second component, or a combination thereof.

3. The holder device of claim 1, wherein said first and second components are configured to withstand or counteract a spring force exerting from said flexible conical part.

4. The holder device of claim 1, wherein said first and second components are movably joined at said common end via a hinge.

5. The holder device of claim 1, wherein said first and second components are two halves of a single piece of material bendable at said common end.

6. The holder device of claim 1, in which said first and second components have round edges, straight edges, or a combination thereof.

7. The holder device of claim 1, wherein said holding means is selected from the group consisting of a clasp, a latch, a strap, a lock, a clip, a fastener, a hook, a click-mechanism, or a combination thereof.

8. The holder device of claim 1, wherein said holding means is attached to, fixed on, formed part of, or integrated in either or both of said first and second components.

9. The holder device of claim 1, wherein said positioning element is firmly attached or fixed onto inner side of said first component at a central location thereof.

10. The holder device of claim 1, wherein said positioning element is formed on inner side of said first component at a central location thereof.

11. The holder device of claim 1, wherein said positioning element fits inside a top opening of said flexible conical part and prevents said flexible conical part from slipping or sliding away.

12. The holder device of claim 11, wherein each of said non-rigid safety cones is compressible to said reduced form substantially linearly from the top thereof downwardly towards the base thereof.

13. The holder device of claim 1, in which said holder device has a capacity to hold one, two, three, four, or more of said non-rigid safety cones.

14. The holder device of claim 1, wherein a light source is integrated with said holder device.

15. The holder device of claim 1, in which said holder device is integrated or formed with one or more features enabling said holder device to hang from or cling onto a device, a vehicle, or a location.

16. The holder device of claim 1, in which said holder device is implemented with colors, reflective materials, or a combination thereof.

17. The holder device of claim 1, in which said first and second components and said positioning elements are formed together by injection molding.

18. The holder device of claim 1, in which said first and second components, said holding means, and said positioning elements are assembled together.

* * * * *